United States Patent [19]

Michel

[11] Patent Number: 4,666,342

[45] Date of Patent: May 19, 1987

[54] ICE BERM FOR USE AS A FOUNDATION FOR AN ARCTIC OFFSHORE STRUCTURE

[75] Inventor: Bernard Michel, Quebec, Canada

[73] Assignee: Recherches B.C. Michel Inc., Ste-Foy, Canada

[21] Appl. No.: 881,530

[22] Filed: Jun. 30, 1986

Related U.S. Application Data

[63] Continuation of Ser. No. 612,362, Jun. 8, 1984, abandoned.

[51] Int. Cl.[4] ..... E02D 21/00

[52] U.S. Cl. ..... 405/217; 405/61; 405/195; 62/260

[58] Field of Search ..... 405/61, 195, 203-205, 405/217, 224; 175/7-9; 62/259.1, 260

[56] References Cited

U.S. PATENT DOCUMENTS

| | | | |
|---|---|---|---|
| 3,738,114 | 6/1973 | Bishop | 405/217 |
| 3,750,412 | 8/1973 | Fitch et al. | 405/217 |
| 3,842,607 | 10/1974 | Kelseaux et al. | 405/217 |
| 3,931,715 | 1/1976 | Fitch et al. | 405/217 |
| 4,055,052 | 10/1977 | Metge | 405/217 |
| 4,177,748 | 12/1979 | Mougin | 405/217 X |
| 4,205,928 | 6/1980 | Thompson et al. | 405/217 |
| 4,325,656 | 4/1982 | Bishop | 405/217 |
| 4,373,836 | 2/1983 | Cox et al. | 405/217 |
| 4,432,669 | 2/1984 | Cox et al. | 405/217 |
| 4,456,072 | 6/1984 | Bishop | 405/217 X |

FOREIGN PATENT DOCUMENTS

| | | | |
|---|---|---|---|
| 914712 | 3/1982 | U.S.S.R. | 405/217 |

OTHER PUBLICATIONS

Aagaard, K., Coachman, L. K., "Recent Studies on Arctic Currents" in Polar Oceans, edited by M. J. Dunbar, Arctic Institute of North America, Jul. 1977, pp. 87-98.

"Ice Island Rig Designed for Arctic Sea Search", Oil and Gas International, vol. 10, No. 12, Dec. 1, 1970, pp. 60, 61, and 94.

Article entitled "Frozen Fill Arctic Platforms", compiled and edited by Thermo-Dynamics, Inc., Seattle, Wash., Jul. 1970.

Ice Island for Arctic Drilling Proposed, report and preliminary design studies compiled by Thermo-Dynamics Inc. of Seattle, Wash., Jul. 1970.

Grounded Ice-Cheap but Limited, Extract from the Offshore Eng. Arctic Supplement of Aug. 1981.

The Norwegian Production Gravity Ice Island, Speech of Eystein Husebye, VTT Symposium 28, Finland, 1983.

*Primary Examiner*—Dennis L. Taylor
*Assistant Examiner*—Nancy J. Stodola
*Attorney, Agent, or Firm*—Schwartz, Jeffery, Schwaab, Mack, Blumenthal & Evans

[57] ABSTRACT

Arctic berm for offshore structure foundation. It is made of several ballasted ice slabs stacked one over the other and welded together to form a solid mass. The berm is obtained by delimiting a uniform ice thickness area over landfast ice, area made up of a central rectangle and arms radiating from the central rectangle, each arm defining successive rectangles. After all rectangles are ballasted sufficiently for them to sink when cut as slabs, one rectangle is cut into a first slab, is allowed to sink slightly and the rectangle next to it in one of the arms is cut and moved over the first slabs to be welded to it into a solid mass. The remaining rectangles of the arms are, in turn, likewise cut and moved over the already piled slabs and welded to them until the berm is finally obtained.

4 Claims, 8 Drawing Figures

ICE BERM FOR USE AS A FOUNDATION FOR AN ARCTIC OFFSHORE STRUCTURE

This application is a continuation of application Ser. No. 612,362, filed June 8, 1984 now abandoned.

The present invention relates to a foundation berm and to a method of making such a foundation berm for use in arctic seas to support a platform intended for oil and gas exploration and/or production.

Artificial islands for arctic seas are already known which are made with caissons loaded with fill material. More recently, it has been proposed that artificial islands of this type be loaded with grounded ice or man-made ice as fill material. Reference is made, in this respect, to the following publications:

AAGAARD, K., COACHMAN, L. K. (1977) "Recent Studies on Arctic Currents" in "Polar Oceans" edited by M. J. Dunbar, Arctic Institute of North America, pp. 89-99.

"ICE ISLAND RIG DESIGNED FOR ARCTIC SEA SEARCH", Oil and Gas International—Dec. 1, 1970—Vol. 10, No. 12, pages 60, 61 and 94;

"GROUNDED ICE—CHEAP BUT LIMITED'-'—Offshore Engineer Arctic Supplement—August 1981—page 13;

"VTT SYMPOSIUM 28"—The Seventh International Conference on Port and Ocean Engineering Under Arctic Conditions—Volume 2,—Technical Research Centre of Finland—Espoo 1983—.

and the following U.S. patents:

U.S. Pat. No. 3,738,114—12/73—Bishop—405/217

U.S. Pat. No. 4,055,052—25/77—Metge—405/217

U.S. Pat. No. 4,373,836—2/83—Cox et al.—405/217

However, the above artificial islands are still quite expensive and there is a definite need for less costly islands and for a more economical way of making them.

It is consequently a main object of the invention to propose a solution which will substantially reduce the building cost of artificial arctic islands by means of resorting to the construction of a new inexpensive underwater foundation berm for setting platforms on top thereof and likewise proposing a simple and inexpensive method of constructing such berms.

A basic premise of the invention lies in that the berm is made by using materials that are mostly available on site, that is, making the berm out of landfast ice floating on the Arctic sea and using sediment material which is available from the local sea bed or elsewhere as in METGE U.S. Pat. No. 4,055,052.

Additionally, a similar simple method of constructing the berm is used. More specifically, the berm is made up of a plurality of slabs of ice that are obtained from the surrounding ice blanket, loaded down with sediment in the form, preferably, of sand or silt that can also be obtained locally. However, in the present invention, the slabs when being stacked one upon the other are securely and safely welded together to form a compact solid mass, eventually laid on the sea bed where the upper structure is intended to rest for exploration or production purposes. The slabs are preferably reinforced so that the resulting berm can more easily resist the powerful blows that may result from the moving ice fields or by stresses induced when the berm is being built and/or towed at different places. Indeed, the berm is likely to be produced at a suitable location where the material is more easily available and for other reasons, being thereafter towed away to the location of use. At the latter location, the platform and relevant equipment is set on the berm in known manner.

It may be pointed out immediately here that the weight of the berm made according to the invention is near to weightless in sea water so that it can easily be moved away from its construction site to its destination of use after being slightly buoyed. If it is eventually desired or required, the berm may be removed from its site and towed away to a new location after the platform and relevant equipment has of course been removed. Because of this near weightless feature also, a berm made according to the invention would be particularly useful where the sea bed is clay which is of course not suitable for bearing heavy loads. Such a berm would also lend itself easily to anchoring by different means so that it becomes possible of resisting the Arctic pack, pressure ridges or other Arctic ice formations where these phenomena are expected to be severe.

The berm is made during the winter months and then towed away in open water, in the spring. Once it has reached its destination, it is sunk and the platform set thereon to provide the desired artificial island. A central isolated steel shaft is then driven through the ice berm to form a moon pool used for drilling purposes.

The method according to the invention of making slabs of uniform cross-section, preferably rectangular, and thickness from landfast ice covering an Arctic sea partially follows the teachings in METGE U.S. Pat. No. 4,055,052 and COX et al. U.S. Pat. No. 4,373,836, that is: an area formed of a plurality of adjacent ice sections, preferably equal in shape and size, is delimited over the ice cover; the area is cleared of snow to expose the ice to ambient atmosphere; the exposed area is allowed to thicken to a predetermined ice thickness while keeping the area free of snow, and a ballasting material is laid and secured over the area, to a thickness suitable to allow the ice sections to sink when severed into slabs.

The present invention is an improved method intended to make a solid underwater ice berm and comprises the following additional steps: smoothing the undersurface of the ice area and removing accumulated brine from the said undersurface; severing a first ice section, from the adjacent sections, to form a first slab and holding this first slab while it is being severed; sinking the first ice slab to a level below the undersurface of the surrounding area; severing, from the area and into a second ice slab, the ice section which is immediately adjacent the first slab; moving this second slab over the first one while preventing it from sinking; moving the first slab up against the second slab and pressing the slabs together to allow them to weld into a solid mass while constantly supporting them from the cover of ice to prevent them from sinking, and repeating the last three steps for the remaining ice sections of the area so that a berm of predetermined thickness is obtained.

According to a preferred embodiment, a reinforcing mesh is placed over the ballasting material and is secured by sprinkling it with sea water which is allowed to freeze into a reinforcing layer.

The ballasting layer is preferably obtained by sprinkling, over the area, a mixture of sea water and sedimental material, allowing the material to freeze into a layer of predetermined thickness whereby to form the aforesaid ballasting material. This material could be either silt or sand or a mixture of both and will usually be available from the sea bed surrounding the construction site.

The invention is likewise broadly claimed herein as a berm for use in an Arctic sea as a foundation pedestal for an offshore structure, said berm being a prismatic solid body of predetermined uniform cross-section, preferably rectangular or polygonal, and predetermined depth and comprising: a plurality of slabs of Arctic ice, said slabs being stacked one over the other and welded together into an integrated mass forming said prismatic body. Again, the berm is likely to be more resistant to external forces by the inclusion of an ice-embedded reinforcement layer over the top ballasting layer, the reinforcement being, for instance, in the form of a steel wire mesh.

The description of one way of carrying out the method according to the invention as well as of a preferred berm is given hereinafter with reference to the appended drawing whererein:

Figure 1:
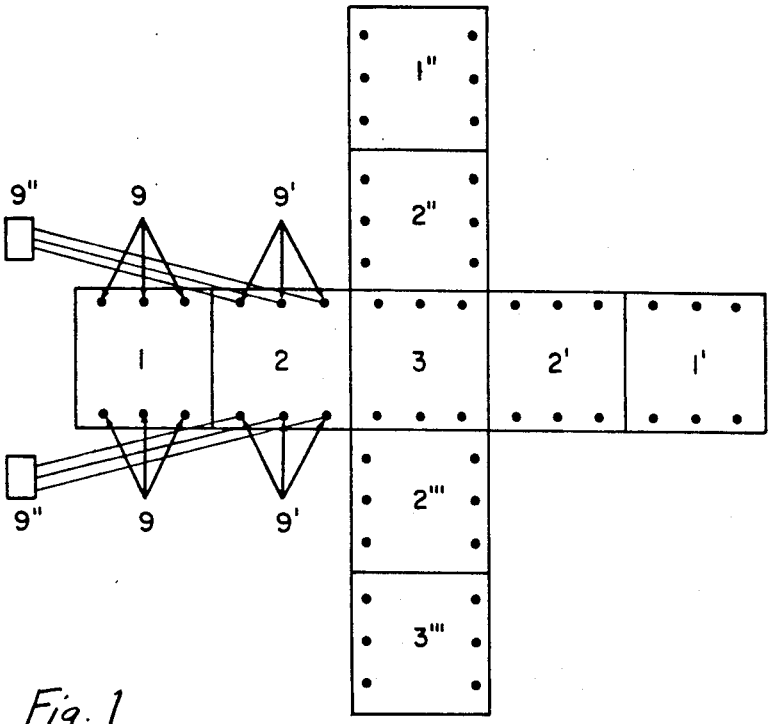
FIG. 1 is a plan view of a layout drawn over an ice carpet as a first step of the method.
Figure 2:
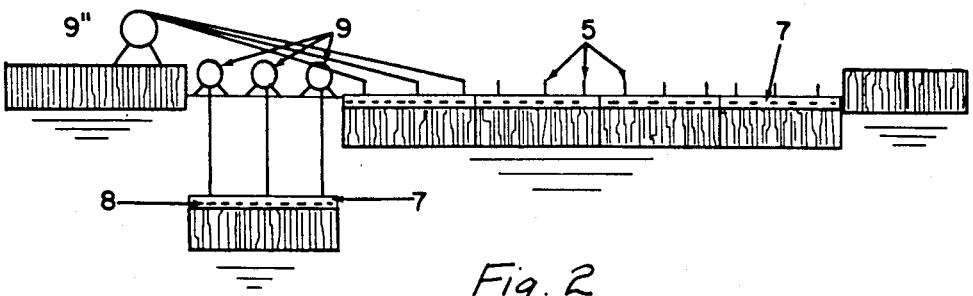
FIG. 2 is ,a cross-sectional view taken in a plane along line A—A of FIG. 1, and FIGS. 3 to 8 vertical cross-sectional views of various artificial islands in which the berm of the invention is used as foundation pedestal.

Reference is now made to FIGS. 1 and 2 for the description that follows of one example showing how the method of the invention may be carried out. In this example, there is intended to make a berm having a 20 m depth or height and a surface area in the form of a square of which the side is 100 m. The berm is to be made by welding, one over the other, nine slabs of ice, each having the form of a square 100 m wide, the slabs being made to weld, that is to firmly adhere to one another so as to form a solid prism of square cross-section. The slabs, when fully made and ready to be applied one over the other, have each a thickness of about 2.2 m, as will be seen hereinafter.

Usually, the berm is constructed at a particular location which is away from the eventual site of use and is towed away to that site when completed.

The various steps that are involved in the making of the berm above described are as follows.

(a) A generally rectangular, cruciform or multiarm area, as shown in FIG. 1, is first selected which is made up of a central square 3 having a 100 m side and followed by four arms radiating therefrom, each arm covering two 100 m-wide squares 1, 2; 1', 2'; 1'', 2'' and 1''', 2'''. These squares will eventually become ice slabs, as explained below.

The ice area is selected in early winter at which time it has a predetermined low thickness, in this example 60 cm. After the cruciform pattern has been laid out, it is entirely cleared of snow and is allowed to thicken, with time, until it reaches a second predetermined depth, which in this example is 150 cm. The thickening takes several weeks and it is of course accelerated by constantly keeping the selected area free of snow.

(b) As the ice free of snow over the selected cruciform area thickens, steel anchor rods 5 are driven through and secured along opposite edges of the squares, as shown in FIG. 1. The top of the rods are left to project above the ice, for a purpose to be specified hereinafter.

(c) The snow-cleared cruciform area is thereafter heavily sprinkled with a mixture of sea water and sedimental material, mixture which progressively freezes into a ballasting layer 7, FIG. 2. The sediment used in this mixture is preferably drawn from the surrounding sea bed by a portable suction dredge but can be carried out by vehicles over the ice cover. For this purpose, it is of course an advantage to select the construction site where appropriate sedimental material can be found, particularly in the form of silt or sand. It is usually expected that arctic sea beds, where berm construction is contemplated, would provide suitable sedimental materials. However, the required ballast material may of course be brought in by ship.

The intent of this ballasting layer 7 is to weight down the slabs up to slightly above gravity equilibrium with sea water. Thus, in the present example, assuming a mixture density of 13 kg/m$^3$ and a slab thickness of 150 cm, it would take an additional layer 7 of about 70 cm to give the slab a total weight that would allow it to sink, if it were free from the surrounding ice blanket, as is contemplated.

When using a small portable suction dredge and considering a square berm 100 m wide, it should not take any longer than about three weeks to make this ballasting layer 7, which is allowed to freeze as it is sprinkled and freeze completely.

The temperature at the top of the cruciform area is, either after or before the ballasting layer 7 is laid out, left to reach a temperature of about −30° C., thus providing a linear temperature differential of approximately −30° from top to bottom considering that the temperature at the bottom will be at about the temperature of the sea water which is close to 0° C. To accelerate freezing, the top should be kept clear of snow at all time.

The anchor rods 5, to be used for moving the eventually obtained ice slabs, as is explained hereinafter, must of course project above the ballasting layer 7.

(d) After the required −30° temperature is reached, the end square 1 is entirely severed, by means of a standard trencher, from the square 2 and the intact ice sheet 2.

A set of winches 9 and appertaining cables cooperate with these anchor rods 5 of the end square 1 to prevent the latter from sinking due to its overload by the ballasting material 7.

(e) Preferably and in order to better resist the action of moving ice and the stresses induced during construction or transportation of the eventual berm, a reinforcing steel mat 8 is then placed over slab 1 and about 2 cm of sea water sprayed over it to freeze and thus embed the reinforcing mat into the slab. This additional water is also left to freeze to about −30° C.

(f) The undersurface of the slab 1 as well as of the undersurface of the remaining cruciform ice area are then smoothened by means of water jets sprayed by underwater divers. This also allows the brine that has accumulated at the bottom to be removed.

(g) The cruciform ice mass, including the ballasting layer and, preferably, the reinforcement layer and having the above-noted linear temperature differential, is now ready for the actual berm construction.

The winches 9 holding the slab 1 are now operated to allow it slowly to sink slightly below the undersurface of the remaining ice area, the situation being diagrammatically illustrated in FIG. 2.

(h) The squares 2, 3 and 2', 1' are then the surrounding ice, by the same standard trencher. These slabs, slightly heavier than water, are prevented from sinking in the same manner as was done with slab No. 1, that is by means of winches 9' of which the cables are tied to the anchor rods 5 of these slabs. It will be noted here that while these winches 9' are set along the ice bordering the slabs 2 and 3, they are movable winches and can therefore be displaced, as will be seen hereinafter.

(i) By means of additional winches 9'' on either side of the end square 1 and with the relevant cables thereof tied to the anchor rods 5 of slab 2, the latter is moved slowly toward the sunk slab 1 and disposed completely over it, the winches 9' being then displaced at the same rate as the slab 2 to keep the latter from sinking.

Using the same technique, the slab 3 is moved to the void which is left by the slab 2 and so on for slabs 2' and 1'. Only slab 1' is left open to the cold atmosphere.

(j) The sunk slab 1 is then lifted by means of the winches 9 so as to contact the undersurface of the slab 2 and in fact rise it slightly to allow for the two slabs to weld together into a solid mass. This integration of the two slabs 1 and 2 enables them to freeze together due to the prior removal of the brine that has accumulated at the bottom of the slabs and also the fact that an appreciable temperature differential about 30° C. exists between the bottom surface of the slab 2 and the top surface of the slab 1 which are now in contact with one another.

(k) The top surface of the slab 2 is reinforced in the same manner as the top surface of slab 1, that is by laying a steel mesh thereon and sprinkling about 2 cm of sea water which is then allowed to freeze so that the mesh becomes solidly embedded in the top layer of the slab.

(l) The mass of integrated slabs 1 and 2 are still held by the winches 9 so that the displaceable winches 9' may be removed. Thereafter, the integral body of the slabs 1 and 2 is sunk sufficiently for the top of slab 2 to stand slightly below the level of the undersurface of the slab 3. The latter is moved over the body of slabs 1 and 2 by the winches 9''. Once the slab 3 is disposed over the body of slabs 1 and 2, the latter are raised for firm contact with the slab 3 and the latter is allowed to weld as in step (j) above.

(m) The above-mentioned steps are repeated with respect to the squares 2', 1'; 2'', 1'' and 2''', 1''' of the three remaining arms of the cruciform area so that, at the end, there is created an integral mass forming a berm which has been made according to the teaching of the present invention. In the case of the above-described example, the berm is thus made of nine integrated reinforced slabs each having a thickness of about 2.2 m for a total berm depth of roughly 20 m.

It would be appreciated that the steps defined above need not be carried out precisely in the same order as indicated, which order may be varied while providing exactly the same results and any modification in this respect will readily come to the man of the art. Thus, all the reinforcing layers can be integrated into the squares of the initial pattern before any square is severed into a floating slab. Yet, as in the above example, the reinforcement layers may only be added once each square is disposed over the preceding one, at the center of the initial pattern. It has also been said, above, that while these reinforcement layers are quite useful, they are not absolutely essential but will provide a berm having a much greater resistance to external forces.

Also, while square slabs are produced in the above example, the slabs may also be rectangular, a square being then considered only as a particular case of a rectangle. Consequently, the term rectangle used in the claims is meant to include squares It will further be realized that, depending on the depth of the berm required, as well as the final thickness of the slabs, each arm may count more than two rectangles. In fact, each arm may actually have only but one rectangle.

It is said above that the initial pattern is kept constantly clear of snow, which acts as an undesired insulating material, and is left so naked until the top surface reaches a temperature of approximately −30° C. During the cooling period, the brine of course drains beneath the ice cover and is therefore washed away when the undersurface is smoothened by means of the high velocity sea water jets, as mentioned above.

Should the salinity of the sea ice still remain too high at the time it is required that the slabs be sunk, drainage pipes may then be incorporated when the reinforcing steel mesh layer is applied.

Welding of the successive slabs is obtained naturally from the heat flow resulting from the fact that the lower layer of a top slab is at approximately water temperature, that is about 0° C., while the top of the slab below stands still at about −30°. With a 2,2 m thick slab and a linear temperature distribution of from −30° C. at the top to 0° C. at the bottom, and assuming gaps up to 10 cm at places between two tightly held slabs, the latter would take approximately two days to freeze and safely weld together.

The resulting berm thus would consist of a stack of sea ice slabs of low salinity, preferably reinforced at each 2 m level with a steel grid, and layers of frozen sedimental material layers (silt or sand) at also every second 2 m. With such a construction, it is expected that the resulting berm will be much stronger in bending than natural sea ice so that it can be transported and subjected to external loads without fracturing, this being particularly so if the berm encloses the aforesaid steel mesh reinforcing layers. With time, brine drainage will continue until the ice berm becomes a solid, reinforced, and almost fresh water ice mass.

Variation in the steel reinforcement is of course to be made according to expected loading conditions.

There may also normally be no need for insulating the berm in any way if some additional volume is added at the start to take care of this melting factor over the life of the structure. In the Beaufort Sea and in most of other Arctic seas, the water temperature from the top to a depth of about 10 m does not rise above 5° C. and this only for a few days during the summer period. The temperature stands at 0° C. if the water surface is covered with ice. Furthermore, the water current velocities in the Arctic seas are generally less than 10 to 15 cm per second (Aagaard and Coachman, 1977). These factors could cause some melting of an underwater ice berm, as above constructed. For example, a 3° C. difference from the melting point over a 30 day-period followed by a 0.5° C. difference for the balance of the year would cause melting of about 8 m of ice at the periphery of the berm. Thus, if a berm has to have a useful width of 100 m and is intended to last three years, it should then be built with an initial side dimension of 125 m. But in many areas of the Beaufort Sea and elsewhere as well, the underwater velocities are lower and the temperature differentials are smaller, this being much more so at greater depths. Consequently, melting would then be much less in those areas so that such particular local conditions should first be determined before dimensioning the required berm.

Heavier melting could be expected if the berm has to be towed over a relative long distance to its final site after being constructed so that this factor has to be accounted for.

It is possible to reduce melting to negligible proportions by the use of an outside insulation. Thus, it would be possible to reduce melting to less than about 0.4 m per year by insulating with standard B.C. fir plywood. If standard polyurethane foam is fixed inside the plywood form, then the rate of melting could be reduced to less than 1 cm per year. Additionally, this insulation may be needed only at the top of the ice berm where the water is warm.

Where insulating panels are preferred, the squares could be cut and severed from the surrounding ice cover after the required predetermined depth, in this case 150 cm, has been attained. Trenches will immediately then be made around all squares to form the required slabs and the insulation set along the periphery and to the total depth of the slab. In fact, the insulation panels could project above the top surface of the layers to define forms for use in building up the ballasting layers and, if desired, the reinforcement layers as well.

As mentioned previously, the resulting ice berm will be slightly heavier than sea water. Once constructed, it can easily be floated and carried away by merely adding small buoyancy tanks and towed away to the desired drilling and/or production site, breaking a path through the ice cover, if need be. The bottom of the sea, at the desired site, is levelled in advance to act as a foundation over which the berm is sunk.

As will readily be understood, the ice berm thus constructed can be used many times at different locations for drilling or other operations. If it has to be moved away, the upper structure or platform is of course taken out and the berm slightly buoyed so that it can easily be towed to the new location. This is very useful when delineation wells have to be closed to an initial drill site.

In most cases, the ice berm is strong enough by itself to resist any loads. Its weakest point lies at the sea bed where the resistance to shear is equal to that of the foundation itself.

As an example and for comparison purposes, a 100 m diameter upper caisson having a 15 m height and a 5 m freeboard with a resistance to ice impact load of 400 MN would require a silt foundation having an angle of internal friction of 15° or more. The ice berm could be 50 m high before the resulting force would start to tilt it.

However, over foundations made of soft clays, the shear resistance would not be adequate to resist ice forces. Piles would then have to be driven through the periphery inside the ice berm.

With the ice berm of the invention, the saving in total volume of material is quite important. For example, a sand berm having 122 m in diameter, 15 m depth and a 1 to 5 slope, requires a fill material of approximately 500 thousand $m^3$. The equivalent ice berm made according to the invention requires 175 thousand $m^3$ of ice, made in-situ, and only 18 thousand $m^3$ of sedimental material such as silt or sand.

It will be appreciated that an ice berm made according to the invention has practically no polluting effect on the environment. Indeed, it can be abandoned to be eventually destroyed by the elements which only means returning mainly to sea water by melting, leaving a natural sedimental material and a small amount of steel mesh to the sea.

As mentioned above, the ice berm may be used for exploratory drilling or as a base or a production site. In the latter case, thermal piles using cold arctic air or other means can be used to prevent the berm from melting.

Figure 3:
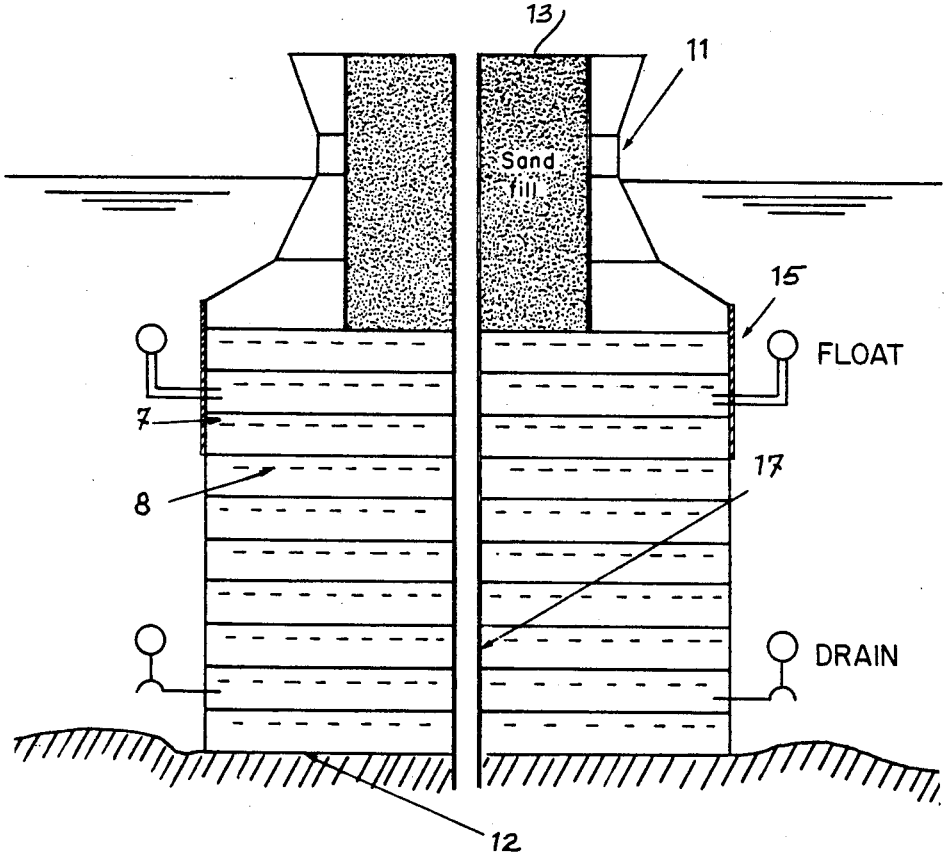

The ice berm can be used with an existing movable superstructure of steel or concrete as shown at 11 in FIG. 3. The berm is sunk into position on a leveled foundation 12 and the floating superstructure brought into place and secured to the top. The inside of the superstructure is then filled with silt, sand or gravel 13 to increase the total weight. If necessary, the upper layers of the ice berm may be insulated at 15 to reduce the melting rate. A central shaft 17 can be sunk into the sand and ice and insulated before drilling starts. The complete system can be floated away and moved to another place.

Figure 4:
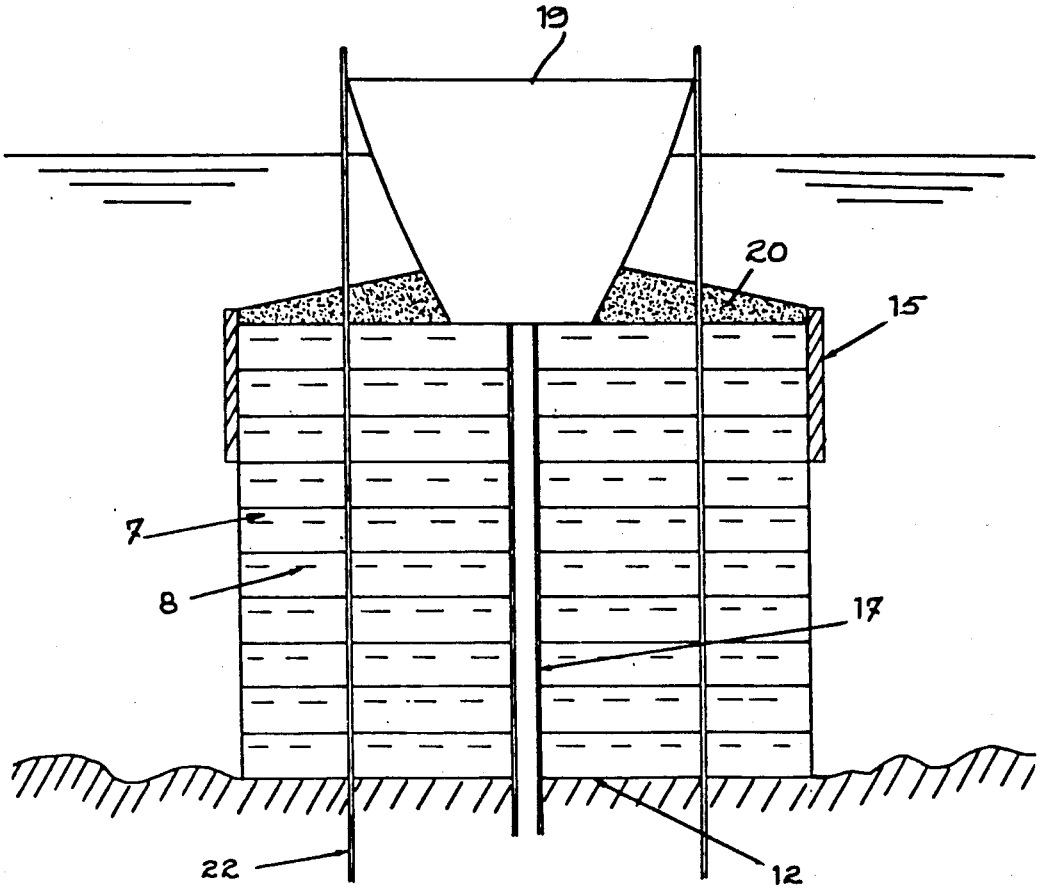

As shown in FIG. 4, an ice berm made according to the invention can also be used with a specially designed water-ballasted drillship 19 which is sunk on a sand bank 20 on top of the berm. Piles may be driven around the ship to anchor it solidly into position, as at 22.

Figure 5:
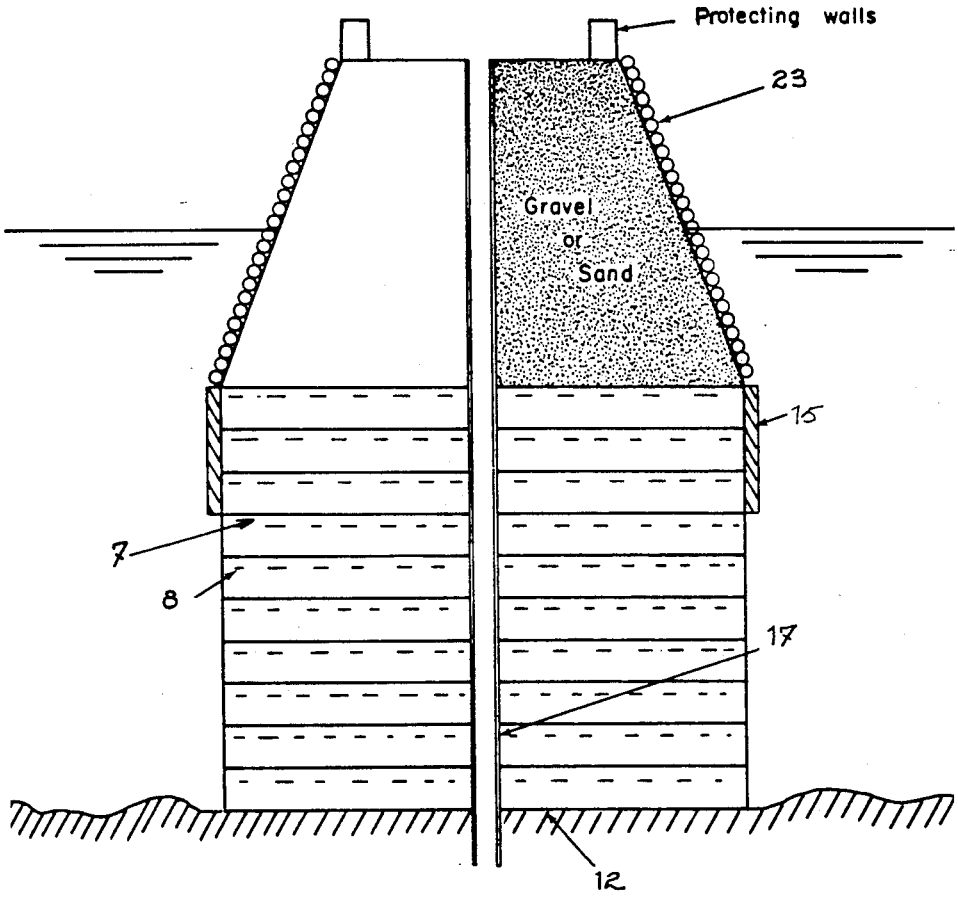

As to the ice berm illustrated in FIG. 5, it directly supports a sandy or gravel island. The island 21 is made by filling material up to the desired level while the side slopes are protected with sand bags 23 or other protection armor against erosion, as is usually the case with sand islands. This concept makes it possible to use the sand island technique in deep sea waters.

Figure 6:
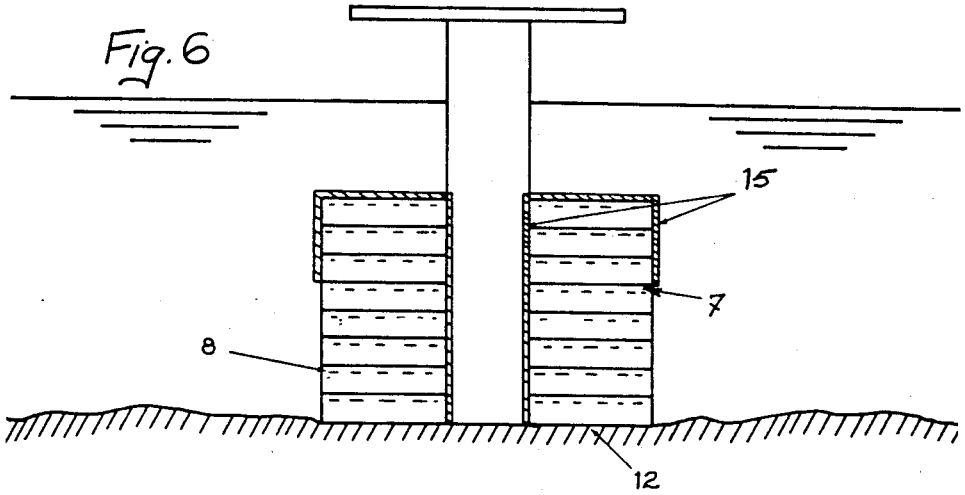
Figure 7:
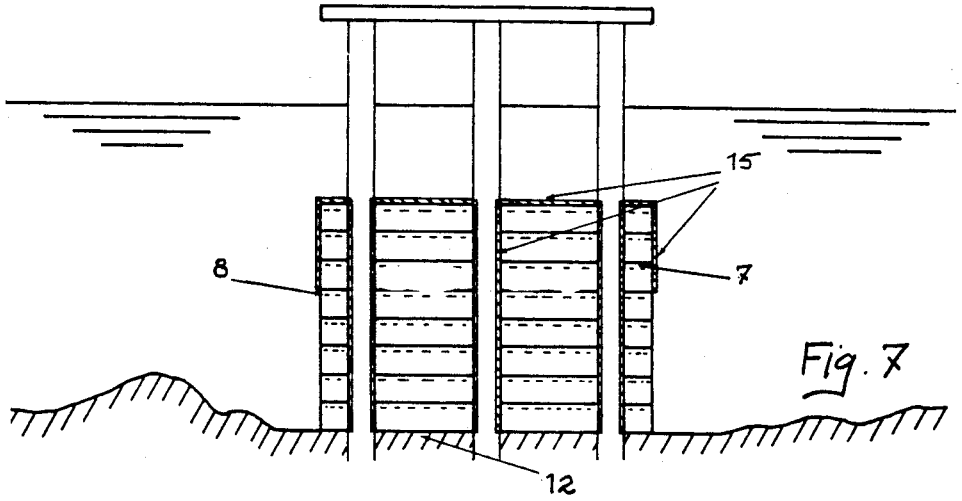

The ice berm described above can finally be used with a monopod platform such as shown in FIG. 6 or a multi-legged platform as that of FIG. 7. In these cases, the ice mass produces the required rigidity for these types of structures in deep water. Again here all elements are re-usable.

Figure 8:
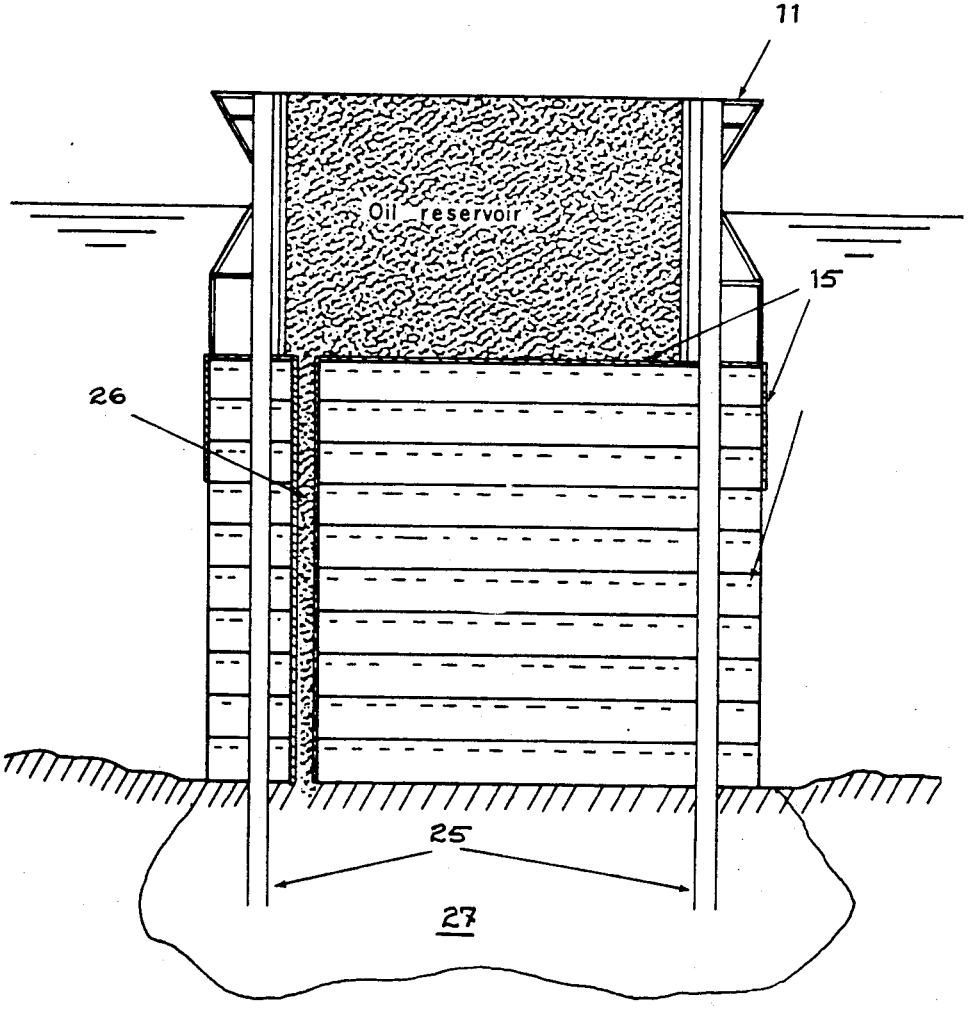

The ice berm may become the solid foundation for a permanent installation. In such a case, however, thermal piles 25 would be needed to keep the integrity of the ice mass in order to prevent it from melting and to weld it solidly to the ground by the formation of a frozen pingo 27. An ice berm which has already been used many times for drilling purposes may end up as a permanent base for such an installation. A typical design of that nature is shown in FIG. 8. The oil pipeline should then be surrounded by thermal piles.

It will be appreciated, from the above description, that the berm may also result from two berm portions, each made separately according to the present method, such as being made at opposite ends of an elongated rectangular area. The two portions may thereafter be stacked one over the other.

I claim:

1. Method of making a solid monolithic berm of predetermined thickness from a cover of ice in an Arctic sea, the method comprising:

(a) delimiting an area formed of a plurality of adjacent ice sections over said ice cover;

(b) clearing said area of snow to expose the ice to ambient atmosphere;

(c) allowing said exposed area to thicken to a predetermined ice thickness while keeping said area free of snow and obtaining a substantial temperature differential between a top and a bottom;

(d) laying and securing a ballasting material over said area, to a thickness suitable to allow said ice sections to sink when severed into slabs;

(e) smoothing an undersurface of said ice area and removing accumulated brine from said undersurface while said ice area is in the sea;

(f) severing a first ice section having the substantial temperature differential between the top and the bottom, from said adjacent sections, to form a first slab and holding said first slab while said first slab is being severed;

(g) sinking said first slab to a level below the undersurface of the surrounding area;

(h) severing, from said area and into a second ice slab, the ice section immediately adjacent said first slab; said second ice section also having the substantial temperature differential between the top and the bottom;

(i) moving said second slab in the sea over said first slab while preventing said slabs from sinking;

(j) moving said first slab up against said second slab and pressing said first and second slabs together to allow, due to the removal of brine, the contact and the temperature differential between the top of said first slab and the bottom of said second slab said slabs to weld into a solid mass while constantly supporting said slabs from said cover of ice to prevent said slabs from sinking, and (k) repeating the steps (h), (i) and (j) for the remaining ice sections of said area so that a berm of said predetermined thickness is obtained.

2. A method as claimed in claim 1, further comprising:

(1) buoying up said berm for allowing floatation and towing thereof to a preselected site.

3. A method as claimed in claim 1, further comprising placing drainage pipes between each slab to drain concentrated brine.

4. A method as defined in claim 1, further comprising placing a reinforcing mesh over said ballasting material and securing said mesh thereto by sprinkling sea water thereover and allowing said sea water to freeze to form a reinforcing layer, over each individual ice section.

* * * * *